US007490385B2

(12) United States Patent
Migli

(10) Patent No.: US 7,490,385 B2
(45) Date of Patent: Feb. 17, 2009

(54) HINGE BASE WITH POSITION ADJUSTMENT

(76) Inventor: Carlo Migli, Via del Pozzo 8, 23900 Lecco LC (IT)

( * ) Notice: Subject to any disclaimer, the term of this patent is extended or adjusted under 35 U.S.C. 154(b) by 276 days.

(21) Appl. No.: 11/055,857

(22) Filed: Feb. 11, 2005

(65) Prior Publication Data

US 2005/0172456 A1 Aug. 11, 2005

(30) Foreign Application Priority Data

Feb. 11, 2004 (IT) ..... MI2004A0222

(51) Int. Cl.
*E05D 7/04* (2006.01)

(52) U.S. Cl. ..... 16/246; 16/237; 16/242; 16/382

(58) Field of Classification Search ..... 16/242, 16/235, 243, 245, 236, 238, 382, 237, 240, 16/246, 249, 254, 272
See application file for complete search history.

(56) References Cited

U.S. PATENT DOCUMENTS 3,977,041 A * 8/1976 Rock et al. ..... 16/238
4,642,846 A * 2/1987 Lautenschlager ..... 16/382
4,862,556 A * 9/1989 Grass ..... 16/382
4,982,476 A * 1/1991 Salice ..... 16/382
5,930,883 A * 8/1999 McWhirt et al. ..... 29/434
5,964,010 A * 10/1999 Huber ..... 16/237
5,966,779 A * 10/1999 Salice ..... 16/382
6,286,185 B1 * 9/2001 Ramsauer ..... 16/236
6,557,211 B2 * 5/2003 Salice ..... 16/382
6,739,019 B2 * 5/2004 Schnelle et al. ..... 16/235
6,971,142 B2 * 12/2005 Lautenschlager ..... 16/382

* cited by examiner

*Primary Examiner*—Robert J Sandy
*Assistant Examiner*—Ruth C Rodriguez
(74) *Attorney, Agent, or Firm*—Shlesinger & Fitzsimmons

(57) ABSTRACT

A position-adjustable base for furniture hinges comprises a base body superposed on a fastening plate.

The base body in turn comprises means designed for fitting of a hinge wing and has a pair of opposite side flanges. Each flange has a slot for sliding fastening which is elongated in the adjusting direction of the base, and the fastening plate has a corresponding through hole appearing in the area under the slot to be passed through together with the latter by a screw for fastening of the base to the piece of furniture and to enable sliding of the base body on the fastening plate in said adjusting direction with the screw head bearing on side edges of the corresponding slot. The holes in the fastening plate are surrounded by a raised collar entering the slot and constituting a rest for the head of the corresponding screw when the screw is tightened. Thus a pre-established sliding-resisting force can be obtained, irrespective of the tightening force of the screws.

16 Claims, 3 Drawing Sheets

HINGE BASE WITH POSITION ADJUSTMENT

BACKGROUND OF THE INVENTION

1. Field of the Invention

The present invention relates to a hinge base provided with adjustment of the position in a vertical direction or in the direction of the hinging axis.

2. State of the Prior Art

Hinges used in the furniture-manufacturing industry are usually provided with a mechanism enabling vertical adjustment of the door so as to allow an optimal alignment with the furniture framework and with other possible adjacent doors.

In the simplest and cheapest form, vertical adjustment is obtained by the same screws fastening the hinge base to the side of the piece of furniture. In accordance with this known technique, the screws for fastening to the piece of furniture, possibly previously mounted on the side flanges of the base, are housed in slots elongated in the direction of the pivot axis of the door. In this way, when the screws are fastened to the side but nut yet fully tightened, vertical sliding of the base and of the hinge, and the door therewith, can be carried out along the stroke allowed by the oval shape of the slots.

This system is surely cheap but it has different drawbacks; since at least two fastening screws are required for each base, at least four screws are to be operated for vertical adjustment of a door; in addition, usually wood screws are utilized and carrying out loosening and tightening operations several times in the same seat may cause an important grip reduction.

Another drawback is represented from a non-continuity in the adjustment; when the screws are loosened, the door falls to the lowest position by effect of its own weight and the correct adjustment position can be only found by attempts.

To prevent the above described drawbacks, the solution generally used in the known art consists in separating fastening from adjustment; for this reason the base is made up of two pieces, a plate directly fastened to the side of the piece of furniture (by means of two wood screws, for example) and a body fastened to the plate by a single metric screw with an oval recess or by a riveted eccentric pin capable of enabling a continuous vertical movement.

The most important technical problem connected with this solution concerns fastening between the plate and the base body that obviously must be as rigid as possible. If fastening takes place by a screw, tightening of which takes place in an oval recess provided at a central position on the base body, the gripping degree can be sufficient, but often the fastening screw, for construction reasons, must be placed laterally on one of the side flanges of the base.

The problem is still more critical if the solution of carrying out fastening by a riveted eccentric pin is adopted. In fact, this solution offers the great advantage of a continuous adjustment, but is not able to ensure the same gripping action as that of a well tightened screw. Many known embodiments of this type of base are known but generally the mechanisms ensuring a good operation have a high manufacturing cost.

It is a general aim of the present invention to obviate the above mentioned drawbacks by providing a position-adjustable base enabling an efficient and continuous adjustment, steady fastening and minimum manufacturing cost.

SUMMARY OF THE INVENTION

In view of the above aim, in accordance with the invention a position-adjustable base for furniture hinges has been conceived which comprises a base body superposed on a fastening plate, the base body comprising means designed for fitting of a hinge wing and having a pair of opposite side flanges, each flange having a slot for sliding fastening which is elongated in the adjusting direction of the base, and the fastening plate having a corresponding through hole appearing in the area under the slot to be passed through together with the latter by a screw for fastening of the base to the piece of furniture and to enable sliding of the base body on the fastening plate in said adjusting direction, with the screw head bearing on side edges of the corresponding slot, characterized in that the holes in the fastening plate are surrounded by a raised collar entering the slot and constituting a rest for the head of the corresponding screw when the screw is tightened.

BRIEF DESCRIPTION OF THE DRAWINGS

For better explaining the innovative principles of the present invention and the advantages it offers over the known art, a possible embodiment applying said principles will be described hereinafter by way of example, with the aid of the accompanying drawings. In the drawings.

DETAILED DESCRIPTION OF THE INVENTION

Figure 1:
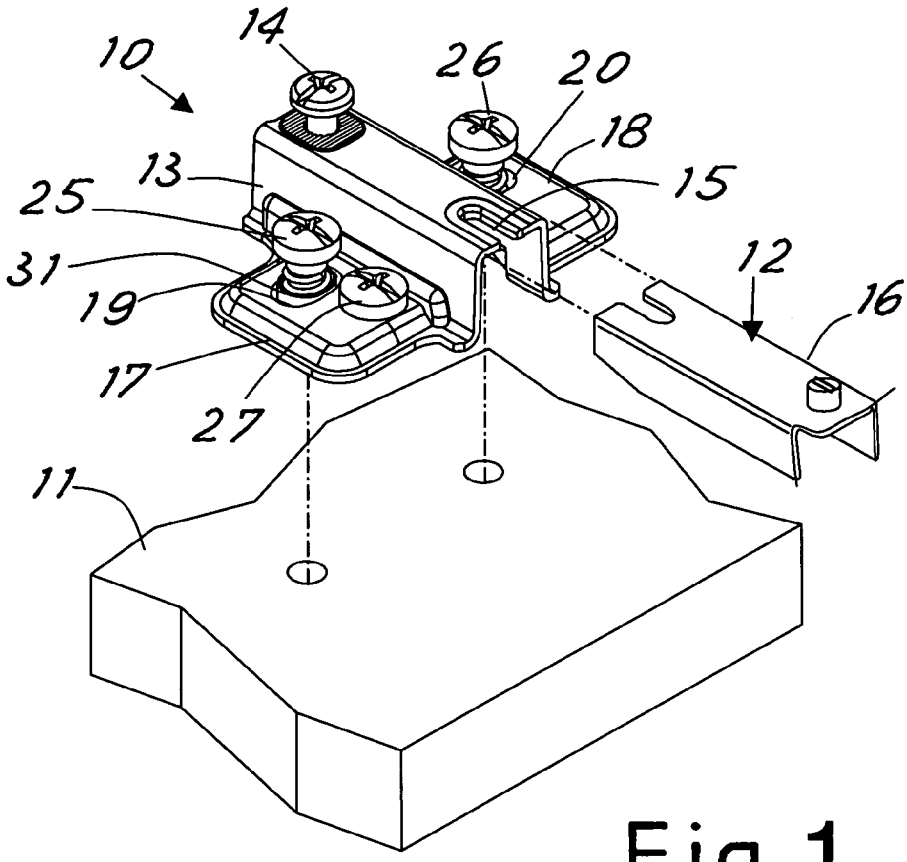
FIG. 1 is a diagrammatic exploded perspective view of a first embodiment of a base in accordance with the invention.

With reference to the drawings, a perspective view of the base denoted at 10 is shown in FIG. 1, said base being designed for fastening at an appropriate position to the side of a piece of furniture 11, in order to fasten a hinge element 12, known by itself and therefore only partly shown, to said furniture side for hinging of a door not shown.

The base body 13, preferably made of bent and drawn metal sheet, comprises a central portion of a shape suitable for coupling and fastening of the fixed hinge portion, following known techniques herein not described in detail. For instance, the central body is provided with threaded fitting means 14, 15 for slidably receiving and securing a wing 16 of the hinge element. Other known systems for fastening of the hinge to the base can be used. The hinge can be of any known type, of an articulated type with several arms and rotation pins, for example.

The base is provided with two side flanges 17 and 18 in which slots 19 and 20 elongated in the direction of the pivot axis of the hinge (transverse to wing 16) are formed. A fastening plate 22 is accommodated under the flanges and parallel thereto, which plate is advantageously made of bent and drawn metal sheet and is provided with fastening holes 23, 24 that have the same distance between centers as the slots 19, 20 and are aligned with the slots to receive screws 25, 26 for fastening of the base to the piece of furniture. The fastening screws have a flat head of a bigger diameter than the slot width so that said screw heads can bear on the side edges of the slots.

Figure 2:
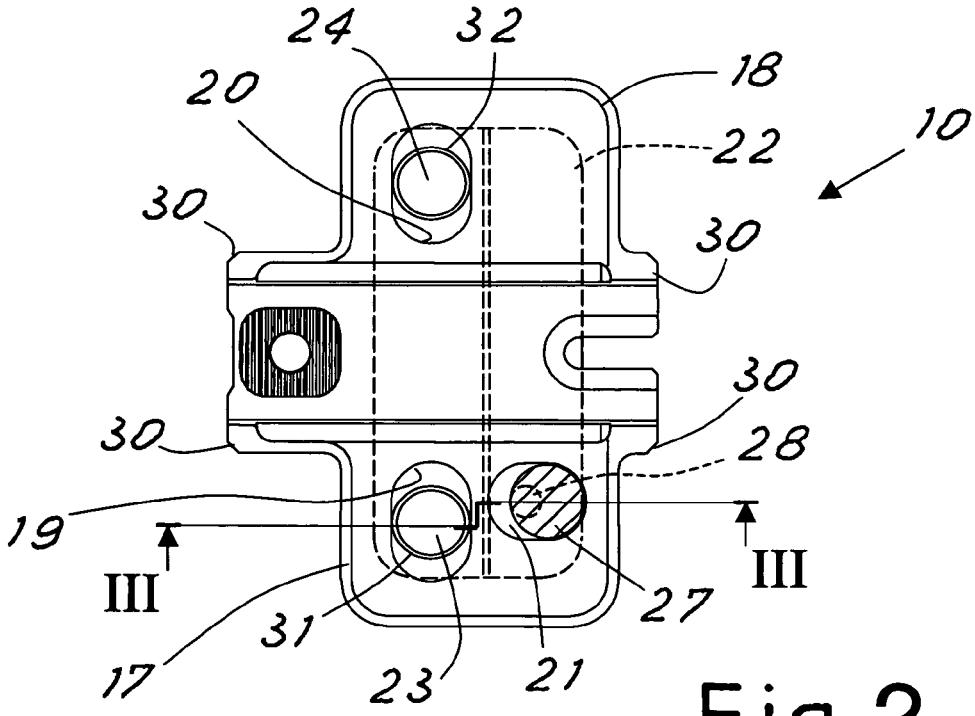
FIG. 2 is a plan view of the base in FIG. 1.
Figure 3:
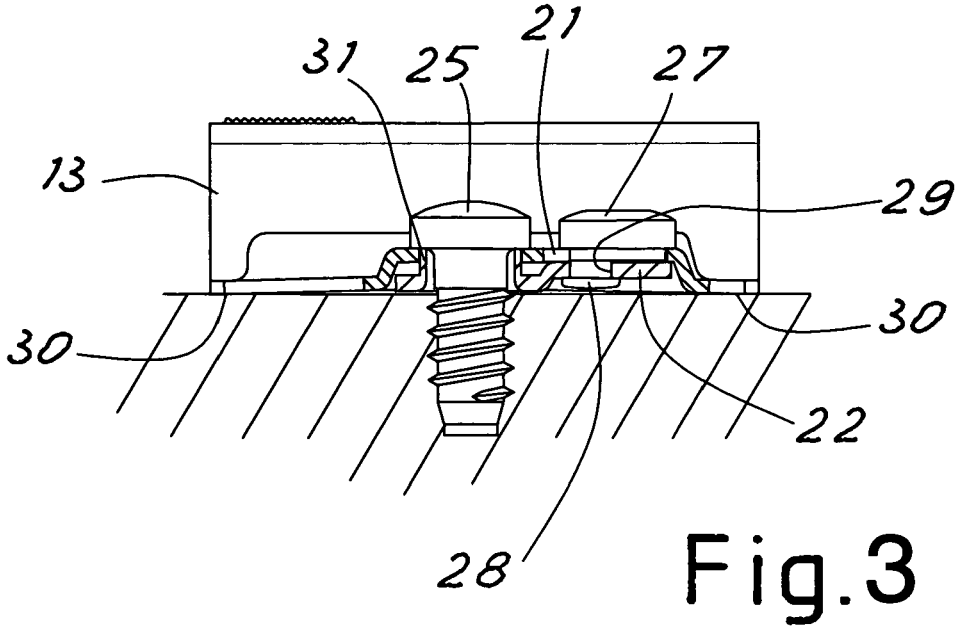
FIG. 3 is a section view taken along line III-III in FIG. 2.

As clearly shown in FIGS. 2 and 3, the two holes 23, 24 enabling passage of the screws for fastening to the piece of furniture have respective raised edges or collars 31, 32. The outer diameter of edges 31 and 32 is suitable for entering the slots themselves, advantageously with a small side backlash. The base body and collars of the fastening holes in the plate are of such sizes that during tightening of the fastening screws to the piece of furniture, the screw head first bears on the flange and then on the raised collar so as to produce a pre-established force resisting sliding of the base body relative to the plate in the adjusting direction.

In particular, in the advantageous embodiment shown the height of collars 31, 32 relative to the support plane of the plate on the piece of furniture is of such a value that before tightening of screws 25, 26 the upper surface defined by each edge 31 and 32 is slightly at a lower position than the upper surface of the flange in which the corresponding slot 19, 20 is formed. During tightening of the screws, the head of the fastening screws therefore first exerts pressure on the region of the base body around the slot and then, following the consequent elastic yielding of the base body suitably obtained, comes into contact with the edge of the respective collar 31, 32 of the fastening plate. At this point driving of the screw is substantially locked, while the base body is secured to the piece of furniture by the screws with a pre-established elastic force. This offers the possibility of an adjusting sliding of the base with a force previously established during planning, and not due in a prevailing manner to the tightening force of the screws.

To obtain the desired elastic force, an elastic deformation of the base body can be provided following different methods. In particular, elastic bending of the base body in the flange region can be provided. As shown still in FIG. 3, it was found particularly advantageous to make the surface identified by the lower edge of the base body 13 with a curved configuration so as to define four rest regions, two at the front end and two at the rear end of the base body. The four regions are denoted at 30 in FIG. 2.

The central portion of the lower surface determined by the base edge, substantially located at the axis of slots 19, 20 is therefore slightly raised relative to the wood surface. In this way, the elastic deformation is obtained by bending of the base portion between the rest points or by bending of the same rest points, so as to enable lowering of the flange surface due to the thrust exerted by the head of the screws being tightened. A sufficient condition is that the deformation place under the flanges between the rest points, before tightening of the screws, be at least slightly larger than the difference in height between the rest plane of the screw head on the flange around the slot and the upper edge of the collar, so that when the screw comes into contact with the collar edge, the central portion of the base body is not yet in contact, or is only slightly in contact, with the fastening plane or the plate.

In other words, it is possible to define the height $H_1$ as the height of the upper surface of the fastening flange relative to the plane of the wood or to the lower surface of the rest regions 30, the height $H_2$ as the height of the upper surface of the flange relative to the lower surface of the central portion, and the height $H_3$ as the height of the upper edge of the collar relative to the lower surface of the plate that is a rest for the wood. To enable good operation of the base, $H_3$ must be of such a value that it is at the same time higher than $H_2$ and smaller than $H_1$. If the ratios between the heights $H_1$, $H_2$ and $H_3$ are complied with, on tightening of the fastening screw, the head begins pushing on the upper surface of the flange until the four rest regions of the base are in contact with the fastening surface. Going on tightening the screw, the base is submitted to a slight deformation ensuring an optimal grip and also eliminating possible clearances under load.

The deformation camber is in any case limited by the design value given by the difference between $H_1$ and $H_3$. In fact, when the lower surface of the plate comes to a rest position on the fastening plane, any further deformation of the base is made impossible due to contact of the screw head that directly discharges the tightening force on the underlying wood through the corresponding collar 31, 32.

Once tightening of the screws has been completed, the base is pushed against the surface bearing on the piece of furniture with a force only depending on design data of the base, such as the material used for the base body, the shape of the latter and the value of the difference between $H_1$ and $H_3$, and on the contrary does not depend on the tightening force of the screws.

Acquiring an independence from the tightening force is very advantageous, because the tightening force is greatly variable depending on elements that do not rely on planning and that cannot be always controlled, such as the material of the furniture side, the type of screw used and above all the driving torque applied to the screw itself.

Present between the base body and fastening plate is means for manual adjustment of the position in the desired adjustment direction, enabling adjustment against said pre-established tightening force.

In particular, in the advantageous embodiment described, linked to plate 22 is also the rotation axis of a cam 27 the cam surface of which is received in an adjusting slot 21 formed in one of the two side flanges. As clearly viewed from FIG. 2, where the cam is shown with the operating head removed, the slot 21 is elongated in a direction perpendicular to slots 19 and 20.

As shown in FIG. 3, the head of cam 27 has a larger diameter than the width of slot 21 and is provided with a suitable seat for an operating screwdriver. The central region of the cam is coaxial with the head and its diameter is slightly smaller than the width of slot 21 with a height slightly smaller than the thickness of the material of the base body at the flange. The cam has an eccentric pin 28 that is riveted, with a minimum side clearance, into a corresponding hole 29 of plate 22. The through hole 29 is such positioned that its axis lies in the major axis of the adjusting slot 21 when holes 23 and 24 are centered on slots 9 and 10. Advantageously, plate 22 is such bent that the upper surface of the region in which the hole 29 is formed is in sliding contact with the lower surface of the inside of flange 17. Riveting of the eccentric pin generally is not able by itself to ensure an optimal grip between the plate and the base body, but the thus obtained fastening is in any case sufficient to ensure assembly during transportation and handling of the bases.

It is apparent that on rotation of the eccentric cam head the base slides on the plate in the extension direction of slots 19, 20, enabling an adjustment of the hinge position in a direction parallel to hinging. With a base in accordance with the invention it is very easy to establish the size of the base in such a manner as to ensure a good grip against accidental sliding and the absence of clearances, without at the same time determining driving of the screw head into the flange 7 while enabling adjustment by the cam with a reasonable effort.

In particular, the force value can be such determined that it is possible to act on the cam to vertically adjust the hinge even when the fastening screws are completely tightened. Since the resisting forces do not depend on the force exerted by the tightened screws, the torque to be applied to the eccentric pin to adjust the hinge keeps constant irrespective of the fastening force applied to the screws.

Thus, with the described mechanism a cheap base has been obtained which is made up of two elements preferably made of metal sheet, joined by a simple riveted eccentric pin that is however able to allow a sophisticated continuous adjustment and to ensure an excellent fastening in the absence of clearances.

Figure 4:
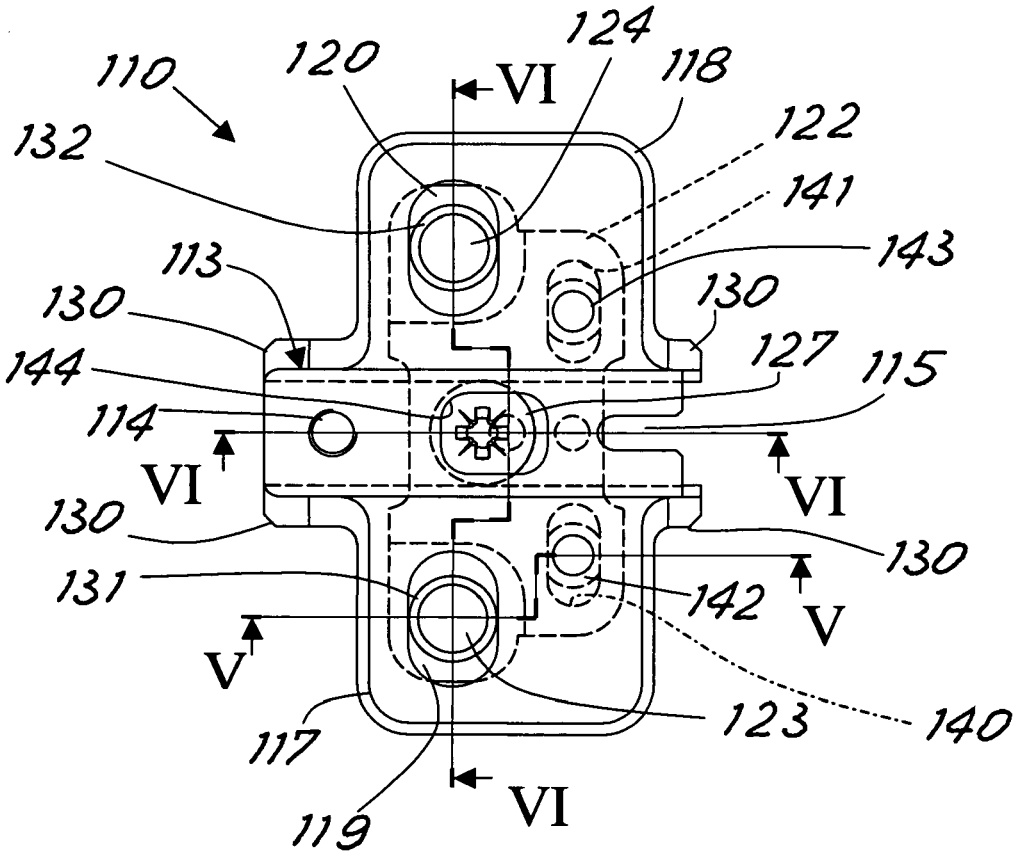
FIG. 4 is a plan view of a second embodiment of a base in accordance with the invention.

Shown in FIG. 4 is a variant of the hinge base made in accordance with the invention. For convenience, elements similar to those of the preceding embodiment are allocated the same numbers increased by one hundred.

In this second embodiment therefore, there is a base 110 with a central body 113 and side flanges 117, 118 provided with fastening slots 119, 120 elongated in the adjusting direction, in the same manner as in the embodiment in FIG. 1. Disposed under the base body there is a fastening plate 122 provided with holes 123, 124 in alignment with the slots and receiving the screws 125, 126 (shown in FIG. 7) for fastening to the piece of furniture. The holes have collars or raised edges 131, 132.

Figure 5:
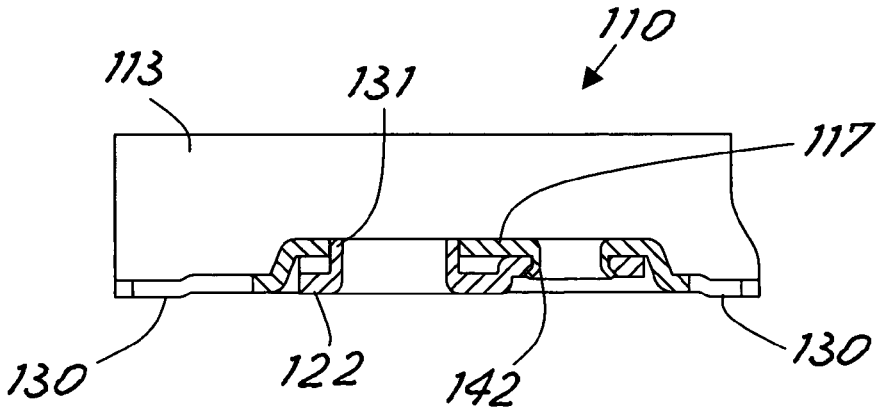
FIG. 5 is a section view taken along line V-V in FIG. 4.

The plate is secured to the flanges so as to be slidable in the transverse extension direction of the slots 119, 120. In the embodiment shown, the slidable engagement is obtained by means of a pair of constraint slots 140, 141 formed in the plate and of corresponding sliding pins projecting from the flanges. The pins are obtained in the side flanges by two holes both having a suitable edge 142, 143 which projects at the inside of the flange and is riveted through the corresponding slot 140, 141, as clearly shown also in FIG. 5. The slots at the lower part thereof can have a slightly flared edge over the whole perimeter.

Figure 6:
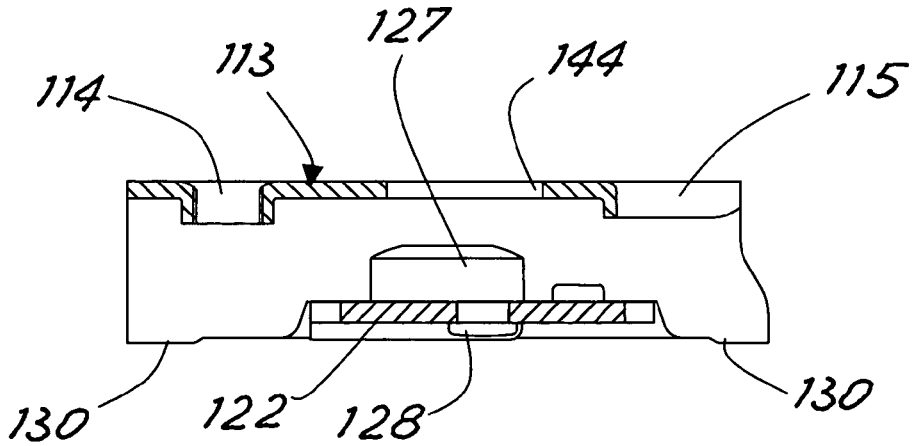
FIG. 6 is a section view taken along line VI-VI in FIG. 4.
Figure 7:
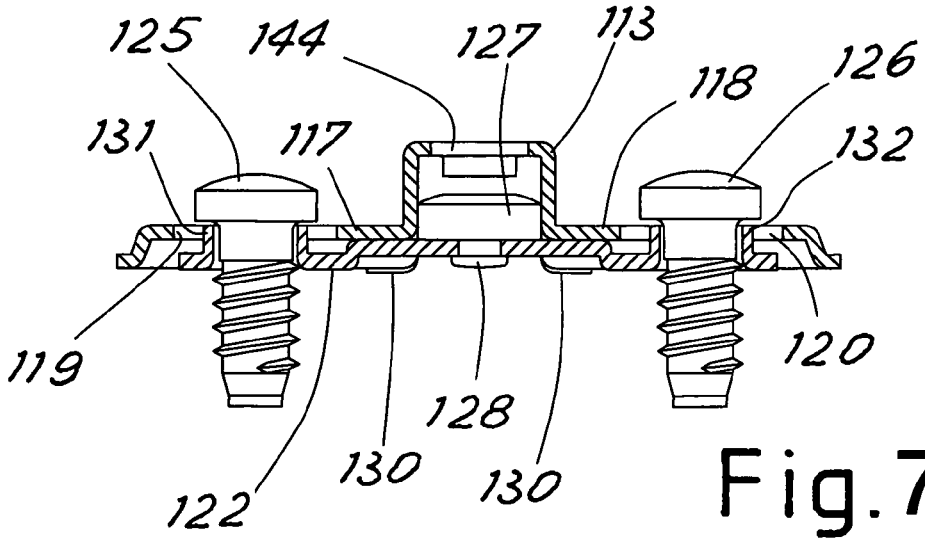
FIG. 7 is a section view taken along line VII-VII in FIG. 4.

As viewed from FIGS. 6 and 7, for obtaining the position-adjusting means a cam 127 is advantageously mounted on a central position of the plate; said cam is rotatably fastened to the plate by means of its eccentric pin 128. As shown in FIGS. 4 and 7, the cam has a cylindrical body to be fitted with minimum clearance between the inner side walls of the central body of the base. For carrying out rotation, the cam has cuts for a screwdriver at the upper part thereof and the base has an access opening 144 over itself. A corresponding opening can be also provided in the hinge wing that will be fixed to the base by known hooking systems, denoted at 114, 115 for example. Rotation of the cam allows a precise vertical adjustment of the hinge position.

The surface determined by the lower edge of the base body is bent at the ends so as to define four rest regions 130 of the base. In the same manner as in the preceding instance, the collars are conveniently sized around the holes 123, 124 so that on tightening of the screws first the base is elastically deformed and then the screws stop against the upper edges of the respective collars. In particular, heights $H_1$, $H_2$ and $H_3$ similar to those of the preceding instance can be defined.

In this way, the force counteracting the adjusting sliding of the base is made independent of the screw-tightening force, thus obtaining the above mentioned advantages.

In this case too gripping of the base-plate assembly on the wood is given by the fastening screws. Riveting of the edges of holes 142 and 143 has the only function of maintaining the two pieces joined together during transportation and handling; possible coupling clearances therefore are of no importance for good operation of the base because they are fully eliminated on fastening of the base to the wood. This makes the riveted coupling particularly cheap. As clearly shown in FIGS. 6 and 7, the plate is conveniently shaped so as to enable the resting and bending action of the base body in spite of riveting.

At this point it is apparent that the intended purposes have been reached by providing a hinge base that is simple and inexpensive (the number of pieces can be reduced to a minimum and no precision working is required for mutual fastening of the base body and fastening plate), while at the same time enabling an efficient and quick position adjustment and a high sturdiness and fastening safety. By virtue of the solution of the invention, the force counteracting sliding of the base can be of such a nature as to enable an easy manual adjustment of the position but to prevent an undesired movement due to the door weight.

Obviously, the above description of an embodiment applying the innovative principles of the present invention is given by way of example only and therefore must not be considered as a limitation of the patent rights herein claimed. For instance, the different parts can have different shapes and proportions, depending on specific requirements. The plate can be as wide as to form the rest surface of the base body by itself. In addition, the elastic resistance of the base body against tightening of the screws until the heads of said screws reach the collars of the holes in the fastening plate can be obtained by means different from bending of the base body. For instance, elastically yielding support elements can be provided at the points the base body rests on the piece of furniture or between the screw heads and the flanges.

What is claimed is:

1. A position-adjustable base for furniture hinges, comprising a fastening plate and a base body superposed on the fastening plate, the base body comprising means designed for fitting of a hinge wing and having a pair of opposite side flanges, with each flange having a slot for slideable fastening which is elongated in an adjusting direction of the base, and the fastening plate having a corresponding through hole appearing in the area under each slot to be passed through together with the slot by a screw for fastening of the base to a piece of furniture and to enable sliding of the base body on the fastening plate in said adjusting direction with the screw head bearing on side edges of the corresponding slot, the holes on the fastening plate being surrounded by a raised collar entering the corresponding slot and constituting a rest for the head of the corresponding screw when the screw is tightened, characterized in that the base body is elastically flexible under a thrust action caused by tightening of the screws against the flanges until contact with the plate collars for pushing rest regions of the base body against the piece of furniture.

2. A base as claimed in claim 1, characterized in that the base body and the collars of the through holes on the plate are such sized that during tightening of the screws for fastening to the piece of furniture, the screw head first pushes on the flange and then on the raised collar so as to stop against the raised collar and produce a pre-established force on the base body, which force counteracts sliding of the base body in the adjustment direction.

3. A base as claimed in claim 1, characterized in that between the base body and the fastening plate there is the presence of means for adjusting the mutual position in said sliding direction.

4. A base as claimed in claim 3, characterized in that said adjustment means comprises an adjusting cam.

5. A base as claimed in claim 4, characterized in that the cam has a head provided with cuts for coupling with an operating tool.

6. A base as claimed in claim 4, characterized in that the cam has an eccentric axis rotatably fitted on the fastening plate and a side cam surface acting in the adjustment direction against corresponding reaction surfaces of the cam present in the base body.

7. A base as claimed in claim 6, characterized in that the cam surface is received in an adjustment slot that is formed in one of the two side flanges, is elongated in a direction perpendicular to the fastening slots and embodies said corresponding reaction surfaces of the cam.

8. A base as claimed in claim 7, characterized in that the cam has an operating head that is disposed over the respective flange and the diameter of which is larger than the width of the adjustment slot so as to constitute a constraint to moving of the base body away from the underlying fastening plate.

9. A base as claimed in claim 6, characterized in that the cam is received in a central portion of the base body that is disposed between the flanges and laterally defines said corresponding reaction surfaces of the cam.

10. A base as claimed in claim 9, characterized in that said central portion of the base body supports said means suitable for fitting of the wing of a hinge.

11. A base as claimed in claim 9, characterized in that said central portion has an upper opening for access to the cam head for manual rotation of the cam.

12. A base as claimed in claim 1, characterized in that the fastening plate is in engagement with the base body to be slidable in the extension direction of the fastening slots but not to be susceptible of movement away from the base body.

13. A base as claimed in claim 12, characterized in that the slidable engagement between the plate and base body comprises a pair of constraint slots formed in the fastening plate and of corresponding sliding pins that project from the flanges, fit into the constraint slots and have a widened fitting head on the other side of the plate with respect to the flange.

14. A base as claimed in claim 1, characterized in that the base body has a pair of rest regions disposed close to the front end and a pair of rest regions disposed close to the rear end of the base body and an elastically yielding region between the two pairs, under the thrust caused by the fastening screws.

15. A base as claimed in claim 1, characterized in that the base body is made of a bent and drawn metal sheet.

16. A base as claimed in claim 1, characterized in that the fastening plate is made of a bent and drawn metal sheet.

* * * * *